United States Patent [19]

Weinert

[11] Patent Number: 4,491,139

[45] Date of Patent: Jan. 1, 1985

[54] SELF-IGNITING SMOKING DEVICE

[76] Inventor: Friedrich Weinert, 219-19-131st Ave., Queens County, N.Y. 11413

[21] Appl. No.: 358,855

[22] Filed: Mar. 17, 1982

[51] Int. Cl.[3] ..... A24D 1/08

[52] U.S. Cl. ..... 131/351

[58] Field of Search ..... 131/351

[56] References Cited

U.S. PATENT DOCUMENTS 2,006,591 7/1935 Fox ..... 131/351

2,721,558 10/1955 Griffiths ..... 131/351

*Primary Examiner*—V. Millin

[57] ABSTRACT

A self igniting device. A tube having a flammable center which can ignite by friction. A piston inserted into the tube. A string fixed to the piston so that by pulling the string the piston will slide out from the tube and so ignite the flammable center. A gas filter on the outside of the tube so toxic gases can escape through the opening of the tube into the surrounding atmosphere as the purified gases are inhaled through the tobacco by the smoker.

1 Claim, 6 Drawing Figures

SELF-IGNITING SMOKING DEVICE

TECHNICAL FIELD

This invention relates to a self igniting device in particular to ignite cigarettes when pulled out of a package without the use of an open flame as created when a match or lighter is used. This reduces substantially—fire hazards.

Background Art

More people die in fires in the United States than in any other industrialized country in the world. The average damage a year is 12 billion dollars and eight thousand deaths and twenty four thousand seriously injured and it seems to be getting worse. Cigarette smoking is blamed to sixty five (65%) percent of all fires caused. Forty percent of these fires are believed to be ignited by matches. Therefore, the inventor has designed a device that ignites a cigarette or a cigar without an open flame and without the assistance of a match. The device is a small tube installed in each cigarette or cigar and will ignite by the pull of one hand through a friction piston which is pulled out of the tube and thereby will ignite the flammable part in the center of the tube inside the cigarette, as the gases thereby produced escape through the opening of the tube into the surrounding atmosphere, so the smoker will inhale only the purified gases from the tobbaco. In this fashion no flame can penetrate to the outside from the cigarette. In bad weather conditions it is quite difficult to ignite a cigarette, not so with this invention. Automobile drivers often provoke accidents by igniting a cigarette by using both hands and loosing their vision at least for a few seconds. The self igniting cigarette does not need the assistance of a second hand, and therefore, is less hazardous. The self igniting device can easily be manufactured with almost no additional cost to the comsumer.

SUMMARY OF THE INVENTION

In accordance with the invention there is provided a self igniting device most useful to ignite cigarettes. The device consists of a fine tube which is flammable at the center, meaning both ends are made of a non-flamable substance. A piston is inserted into the tube fastened to a string which penetrates the tube and therefore can be anchored to the bottom of a cigarette pack or hanging loosely and therefore can be pulled by hand in order to pull piston out of the igniter tube. The piston is made usually of red phosphor as the midsection of the tube is usually made from sulpher potassium-clorate mixture. By pulling the string the piston slides through ingitor tube and therefore ignites midsection by surface contact between piston and center section of the tube. The flammable midsection is contained on the outside by a cotton filter moistened with parafine oil. When midsection is ignited it will burn in both directions, meaning inside the tube and against the cotton filter. The burning of the cotton fiber will burn the surrounding tobacco and thereby ignite the cigarette. The purpose of the cotton filter is to filter gases emanating from the flammable midsection, meaning only purified smoke can penetrate through the cotton filter as toxic gases are channeled through the tube into the atmosphere. The entire unit can easily be installed inside a cigarette. In general it is preferable to use some kind of glue or molasses, mixed with the tobacco at the very front of the cigarette containing the igniting unit. The glue will stiffen the tobacco in order to anchor igniting unit inside cigarette. Further objects of this invention will be printed out in the following detailed description and claims and illustrated in the accompanying drawing which discloses by way of example and principal of this invention and the best mode which has been contemplated of applying that principal.

DETAILED DESCRIPTION OF A PREFERRED EMBODIMENT

Figure 1:
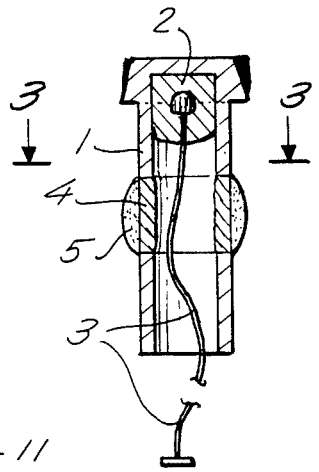
FIG. 1 is a schematic vertical view of the igniting device whereby piston (2) is inserted into the device.

Referring to FIG. 1 there is shown a cigarette igniting device of a tube (1) a piston (2) and a string (3). The igniter tube (1) is partly made from a nonflamable substance (1) and a flamable substance (4) placed in center of the tube called midsection. Flammable section (4) is surrounded with cotton filter (5) moistened with alcohol or paraffin oil. Therefore, if piston (2) is pulled by string (3) out of the tube (1) the flammable middle section (4) will ignite by surface contact of piston (2) the middle section of the tube is made from a material which ignites by friction such as sulpher potassium clorate mixture. Piston is made of red phosphor.

Figure 2:
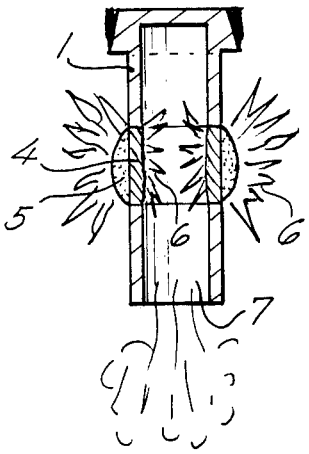
FIG. 2 is a schematic vertical view of the igniting device whereby piston is pulled out of the device by igniting flammable part (4).

FIG. 2 shows igniter tube (1) in ignited condition indicated by flames (6) called first stage. Gases hereby produced exiting through the opening of the tube (7). Second burning stage is indicated when cotton filter (5) starts to burn and thereby inflames the surrounding tobacco for smoking purpose. The purpose of this design is to ignite a cigarette without an open flame to prevent a fire hazard as introduced when using matches.

Figure 3:
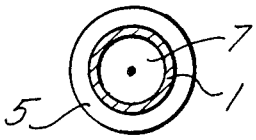
FIG. 3 is a top view of the self igniting device.

FIG. 3 shows a cross section front view of the igniter tube whereby opening (7) is concealed by tube (1) surrounded with cotton filber (5).

Figure 5:
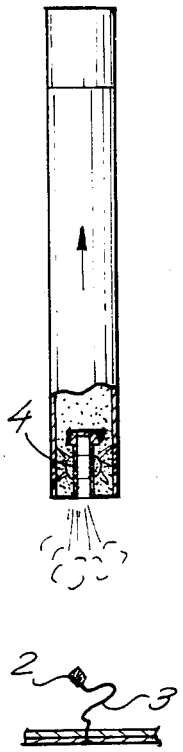
FIG. 5 is a partly sectional plan view of the self igniting device in ignited position installed inside a cigarette.
Figure 4:
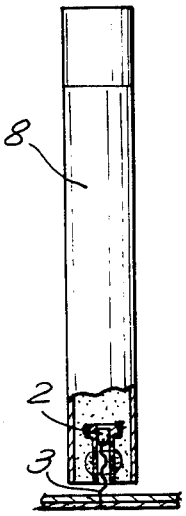
FIG. 4 is a partly sectional plan view of a self igniting device in neutral position installed inside a cigarette.

FIG. 4 shows a cigarette (8) anchored to the bottom of the cigarette pack by a loose string (3) connecting piston (2) with bottom plate (9) when cigarette is pulled out as shown in FIG. 5 piston (2) has ignited middle section of flammable tube (4) indicated by smoke coming out of tube opening. This gives the smoker a few seconds before ventilating the cigarette by breathing action.

Figure 6:
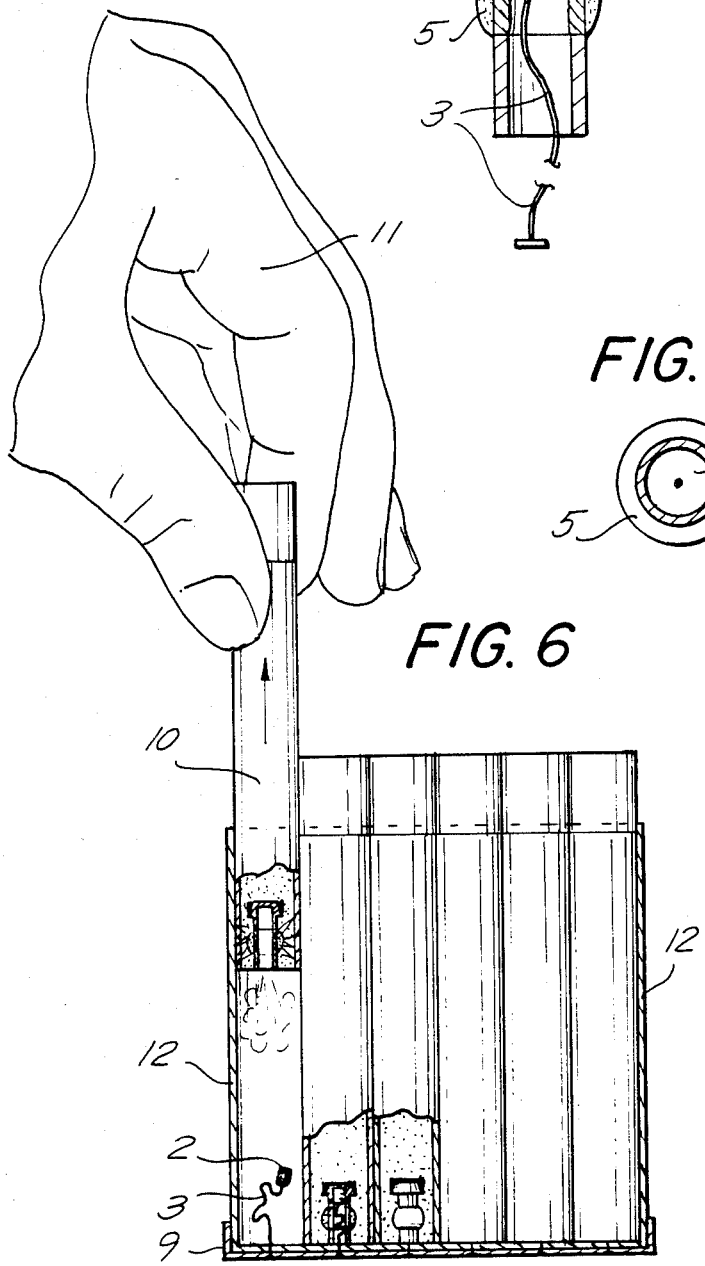
FIG. 6 is a partly sectional explanatory view of the igniting device installed inside a pack of cigarettes.

FIG. 6 shows a partly sectional explanatory view of a igniter unit whereby a cigarette (10) is pulled by hand (11) out of a pack of cigarettes (12). The cigarette (10) is shown in cross section to show igniter unit during ignition indicated by the separation of piston (2) which now lays loosely with string (3) at the bottom of the cigarette pack (9). This system can be applied to any cigarette pack without undergoing major changes of the cigarette pack (12) with the exception of a bottom plate (9).

I claim:

1. A cigar or cigarette in combination with a self-igniting device inserted into the end of the cigar or cigarette to be lit wherein said device comprises a tube having a central portion chemically treated with a flammable substance that will ignite upon friction; a piston inserted into the tube and frictionally fitted therein; a string with one end attached to said piston so that when the string is pulled the piston will frictionally engage said central portion so as to ignite said flammable substance; a gas filter on the outside of said tube surrounding said tube wherein said filter is a cotton filter moistened with alcohol and paraffin oil.

* * * * *